US005441367A

United States Patent [19]

Toth

[11] Patent Number: 5,441,367

[45] Date of Patent: Aug. 15, 1995

[54] MULTIPLE-WALLED DIVER'S BUOYANCY COMPENSATOR

[75] Inventor: Douglas J. Toth, Huntington Beach, Calif.

[73] Assignee: Under Sea Industries, Inc., Rancho Dominguez, Calif.

[21] Appl. No.: 52,709

[22] Filed: Apr. 27, 1993

[51] Int. Cl.[6] ..... B63C 11/02

[52] U.S. Cl. ..... 405/186; 405/185; 441/106

[58] Field of Search ..... 405/186, 185; 441/106, 441/116, 112

[56] References Cited

U.S. PATENT DOCUMENTS

| | | | |
|---|---|---|---|
| 4,561,853 | 12/1985 | Faulconer et al. | 405/186 X |
| 4,778,307 | 10/1988 | Faulconer | 405/186 |
| 4,778,425 | 10/1988 | Hattori | 405/186 X |
| 4,810,134 | 3/1989 | Faulconer | 405/186 |
| 4,986,700 | 1/1991 | Takeda | 405/186 |
| 5,074,714 | 12/1991 | Franco | 405/186 |

*Primary Examiner*—Dennis L. Taylor
*Attorney, Agent, or Firm*—Leonard Tachner; Flam & Flam

[57] ABSTRACT

A diver's buoyancy compensator that allows greater design freedom in the placement of the air-containing buoyancy chambers to better suit the needs of the diver. A preferred embodiment of the invention comprises four distinct surfaces, two of which make up the two halves of a floatation chamber that provides primarily back mounted floatation and the other two of which provide the chamber for more forward front mounted floatation under the arms and over the shoulder. After the two halves of each such chamber are joined to one another, the chambers are joined to each other with interchamber passageways providing free passage of air into both bladder chambers, whereby inflation and deflation in both chambers occur substantially simultaneously through a single valve or hose which may be connected to either such chamber.

4 Claims, 2 Drawing Sheets

MULTIPLE-WALLED DIVER'S BUOYANCY COMPENSATOR

BACKGROUND OF THE INVENTION

1. Field of the Invention

The present invention relates generally to the field of diving equipment and more specifically to diver's buoyancy compensators or floatation jackets and more particularly to an improved buoyancy compensator the construction of which allows increased flexibility for optimizing placement of buoyancy chambers for the comfort and stability of the diver.

2. Prior Art

The current practice in the buoyancy compensator art is to create an airtight bladder from two symmetrical pieces of fabric that are both coated on their inner air holding surfaces with a heat fusible material. The desired shapes of the material are cut out and the edges are heat fused by ultrasonic welding equipment to provide an airtight bladder for the buoyancy compensator. A variety of baffling methods and other attachments have been employed to conform the bladder to the desired shape. For example, see U.S. Pat. No. 4,810,134 to Faulconer et al.

Unfortunately, the practice of using only two pieces of symmetrical fabric restricts the shape of the bladder and hence, the placement of buoyancy to roughly that which can be thought of as flat patterns or pillows that become enlarged when inflated. These patterns are few in configuration and common in the industry among various manufacturers. There is a division of general configuration however that is referred to as back mounted compensators that provide all of the floatation on the back of the diver and front mounted compensators that provide the majority of floatation in front of the diver over the shoulders or under the arms. These two configurations have both advantages and disadvantages, but neither is optimal for the diver. The back mounted devices, when inflated, have a tendency to push the diver's head and face under the water when he is swimming in a prone, face down position on the surface or if he is in an upright resting position. It is excellent however when swimming on the surface on the back in a reclining position. The front-mounted jacket has just the opposite affect. It does not provide enough back support in the reclining position for comfortable surface swimming. It is very stable in the upright floating position and does not push the face into the water during prone, face down surface swimming. These two configurations require considerably different placement of the buoyancy chambers and building a compensator that could make optimal use of the buoyancy placement used in both back and front mounted chambers cannot be currently achieved with conventional construction methods.

It would therefore be desirable to provide a buoyancy compensator having a construction which provides the advantages of both the aforementioned back mounted devices and front mounted devices in a unitary structure so that the swimmer has adequate support on both front and back, simultaneously.

SUMMARY OF THE INVENTION

The present invention comprises a novel construction for a diver's buoyancy compensator that allows greater design freedom in the placement of the air-containing buoyancy chambers to better suit the needs of the diver than is possible in conventional construction techniques of the prior art. This construction allows significant flexibility in designing new shapes for optimizing placement of the buoyancy chambers for the comfort and stability of the diver. Conventional baffling mechanisms can still be utilized to control the shape and expansion of the compensator and additional weldments and reinforcements can be made for the attachment of harnesses and the like. A preferred embodiment of the invention comprises four distinct surfaces, two of which make up the two halves of a floatation chamber that provides primarily back mounted floatation and the other two of which provide the chamber for more forward front mounted floatation under the arms and over the shoulder. After the two halves of each such chamber are joined to one another, the chambers are joined to each other with interchamber passageways providing free passage of air into both bladder chambers, whereby inflation and deflation in both chambers occur substantially simultaneously through a single valve or hose which may be connected to either such chamber.

OBJECTS OF THE INVENTION

It is therefore a principal object of the present invention to provide a multiple walled diver's buoyancy compensator having at least two distinct but interconnected buoyancy chambers, one of which provides primarily back mounted floatation and one of which provides for a more forward front mounted floatation under the arms and over the shoulder of the diver.

It is an additional object of the present invention to provide a multiple-walled diver's buoyancy compensator, which in a preferred embodiment, comprises four distinct pieces of fabric fused together to form two distinct, but interconnected air chambers to optimize placement of buoyancy on both front and back of the diver for greater comfort and increased stability.

It is still an additional object of the present invention to provide an improved diver's buoyancy compensator having a multi-chamber construction, wherein each such chamber is in fluid communication with the other such chamber and wherein one such chamber provides back buoyancy support for the diver and the other such chamber provides mostly front forward support for the diver for increased diver comfort and stability.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
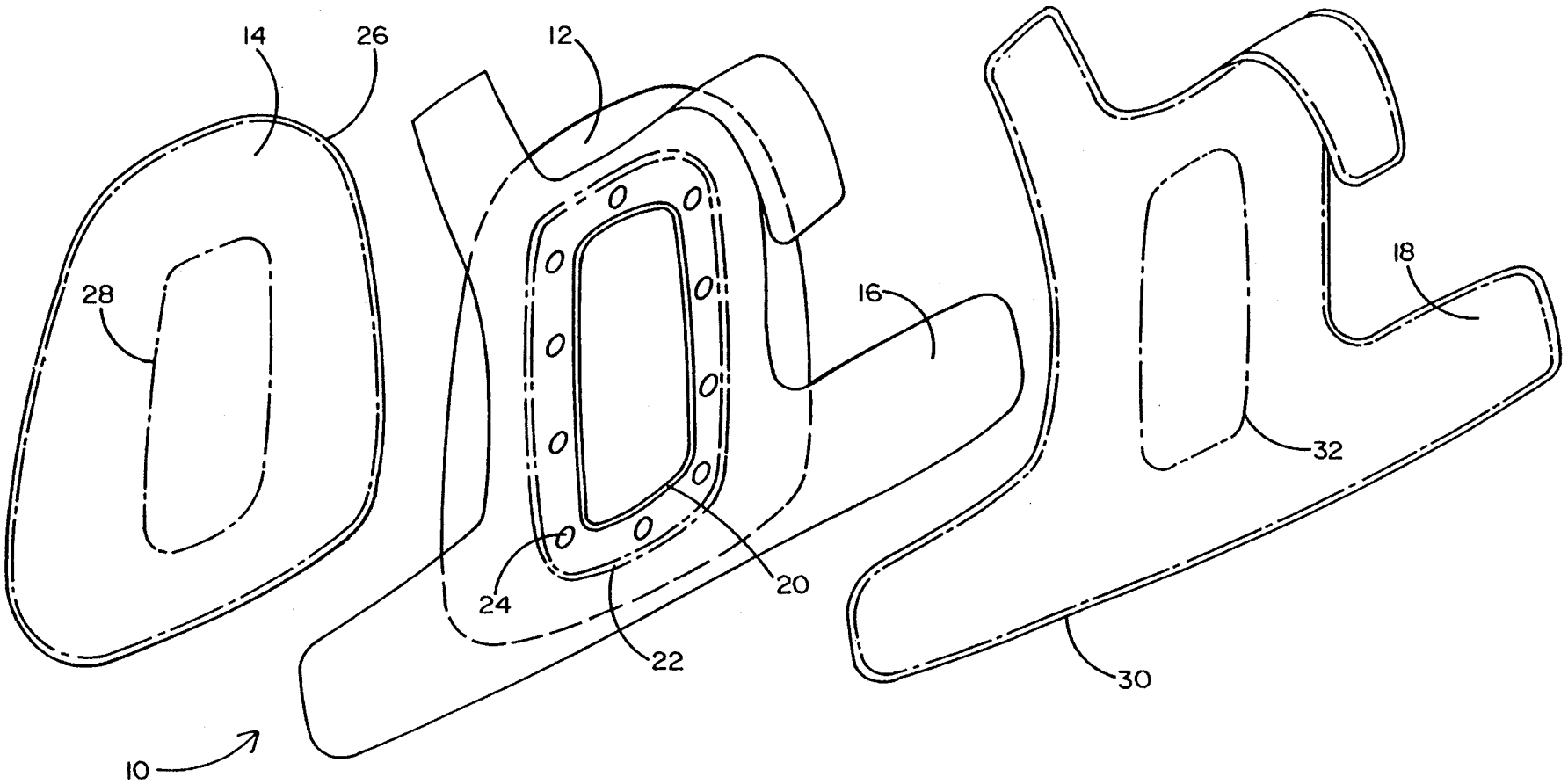
FIG. 1 is an exploded view of the multiple chamber construction of the present invention illustrating the components thereof.
Figure 2:
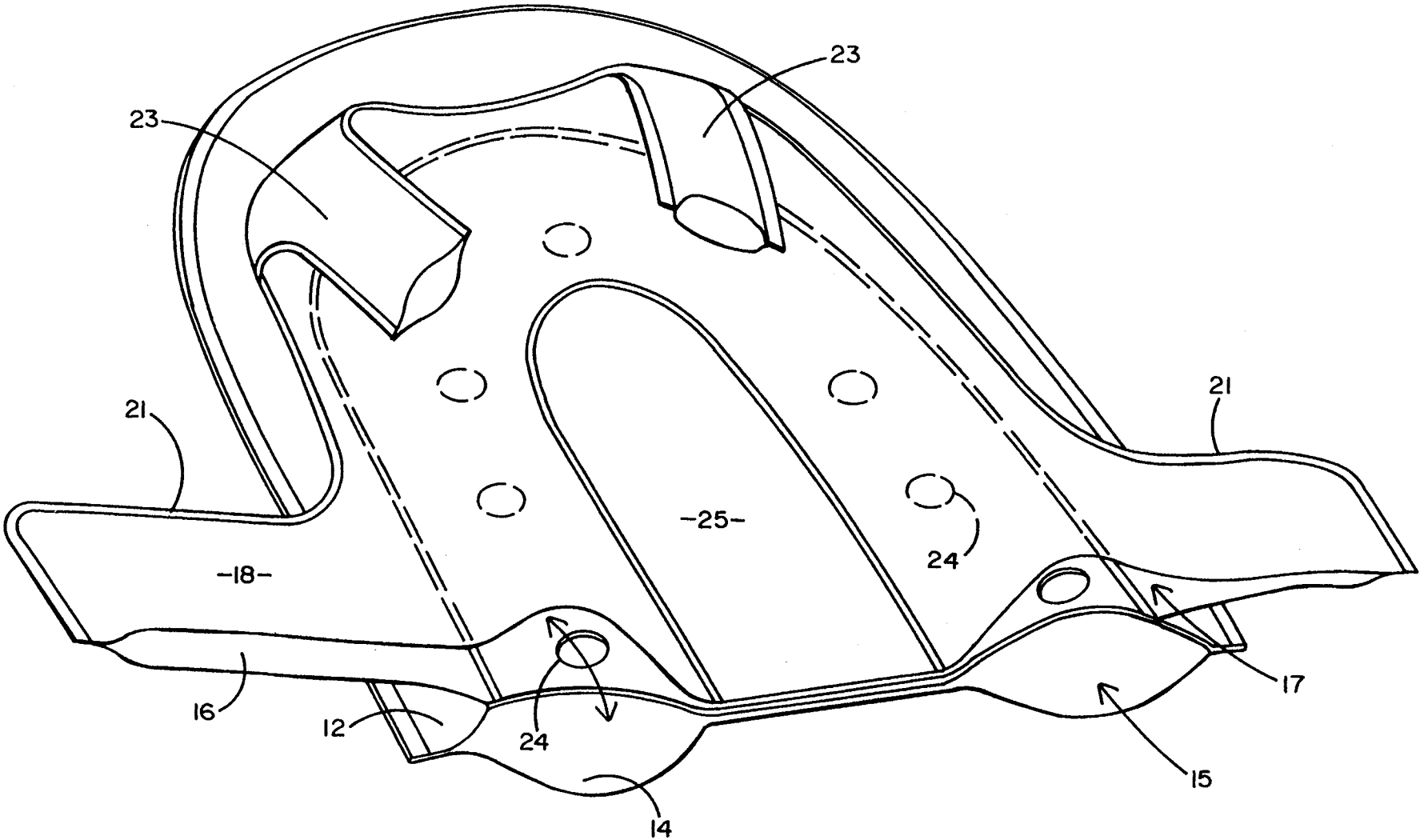
FIG. 2 is a cutaway view of the buoyancy chambers created by the members shown in FIG. 1 when fully joined in the manner described hereinafter.

Turning now to the accompanying FIGS. 1 and 2, it will be seen that the buoyancy compensator 10 of the present invention comprises a rear floatation chamber 15 formed by first fabric member 12 and second fabric member 14; and a forward floatation chamber 17 formed by third fabric member 16 and fourth fabric member 18.

Members 12 and 16 are made of a fabric material that is coated with a heat fusible plastic on both their inside and outside surfaces. Members 12 and 16 are fused together in a plastic weld process along welds 20 and 22. The sealing weld 22 provides the outer airtight seal between the dissimilar shapes of members 12 and 16. The weld 20 seals off a non-inflating attachment area 25 for a scuba tank harness.

After members 12 and 16 are joined, member 12 is joined to member 14 at perimeter weld 26 and interior weld 28. Joining members 12 and 14 creates the substantially rearward buoyancy chamber 15 of the shape of members 12 and 14. Weld 28 matches the shape and location of weld 20 on member 12. Members 14 and 18 need only be of a fabric coated on one side with a fusible coating because each is welded on just one surface.

Member 18 is joined to member 16 at a perimeter weld 30 and interior weld 32. Joining members 16 and 18 creates the substantially forward-placed buoyancy chamber 17 of the shape of members 16 and 18. The shape of members 16 and 18 provides waist portions 21 and shoulder straps 23.

Holes 24 are provided through members 12 and 16 to permit free passage of air into the chamber 15 and 17. The novel construction of the buoyancy compensator of the present invention thus provides two distinct buoyancy chambers structurally interconnected to be inflated or deflated simultaneously. One such chamber is configured to provide floatation primarily at the back of the diver and the other such chamber is configured to provide floatation primarily at the front of the diver. This construction permits advantageous flexibility in designing novel shapes of members for optimizing placement of the buoyancy chambers for the comfort and stability of the diver. Conventional baffle mechanisms may still be utilized to control the shape and expansion of the compensator. Furthermore, additional weldments and reinforcements may be made for attachment of harness and the like.

Having thus described an exemplary embodiment of the invention, what is claimed is:

1. A dual floatation chamber for a diver's buoyancy compensator, the chamber comprising:

at least four layers of air-impervious fabric including a top layer, a bottom layer and two intermediate layers;

said top layer being perimeter-welded to one of said intermediate layers;

said bottom layer being perimeter-welded to another of said intermediate layers;

said intermediate layers being welded to one another at a location spaced from their respective perimeters; and at least one common air passage extending through said intermediate layers.

2. The chamber recited in claim 1 wherein said intermediate layers are welded together along a first enclosed seal line and wherein said air passage lies within a perimeter formed by said first seal line.

3. The chamber recited in claim 2 further comprising a second enclosed seal line within and concentric to said first seal line and forming a non-inflatable region within said second seal line and an intermediate region between said first and second seal lines.

4. The chamber recited in claim 3 wherein said air passage is positioned in said intermediate region.

* * * * *